US005341662A

United States Patent [19]

MacDonald

[11] Patent Number: 5,341,662

[45] Date of Patent: Aug. 30, 1994

[54] KEY HOLDER

[76] Inventor: Sumner B. MacDonald, 285 N. Farm Dr., Bristol, R.I. 02809

[21] Appl. No.: 138,145

[22] Filed: Oct. 15, 1993

Related U.S. Application Data

[63] Continuation of Ser. No. 881,051, May 11, 1992, abandoned.

[51] Int. Cl.[5] ..... A47G 29/10

[52] U.S. Cl. ..... 70/456 R; 70/459

[58] Field of Search ..... 70/356 R, 356 B, 357, 70/358, 359; 206/37.2, 37.5, 37.7, 37.8; 24/573.5, 599.2, 598.8, 600.2

[56] References Cited

U.S. PATENT DOCUMENTS

| | | | |
|---|---|---|---|
| 691,433 | 1/1902 | Baker | 70/459 |
| 765,823 | 7/1904 | Erb, Jr. | 70/456 R |
| 1,276,122 | 8/1918 | Scheid | 70/459 |
| 1,473,983 | 11/1923 | White | 24/600.2 |
| 2,301,611 | 11/1942 | Brociner | 70/19 |
| 2,396,615 | 3/1946 | Sorrentino | 70/456 R |

FOREIGN PATENT DOCUMENTS

| | | | |
|---|---|---|---|
| 552092 | 5/1922 | France | 70/459 |
| 796039 | 10/1935 | France | 70/459 |
| 988112 | 6/1949 | France | 70/459 |
| 1203520 | 8/1970 | United Kingdom | 24/573.5 |

*Primary Examiner*—Peter M. Cuomo
*Assistant Examiner*—Darnell M. Boucher

[57] ABSTRACT

A key holder in which two portions are connected for relative movement between a closed position therebetween and a widely opened position therebetween.

1 Claim, 1 Drawing Sheet

KEY HOLDER

This application is a continuation of application Ser. No. 07,881,051, filed May 11, 1992 now abandoned.

FIELD OF THE INVENTION

This invention relates to holders for keys and the like.

SUMMARY OF THE INVENTION

I have discovered that a holder easily loadable with perforated objects and unloadable, even though a key, for example of an object, is thick in its perforated zone is done by providing, in combination, a pair of connected object-retaining portions, the pair being relatively movable while connected to selectively increase a gap therebetween.

In the presently preferred embodiment, one of the pair is a hook, round in cross-section and fixedly mounted in a base, and the other of the pair is an internally threaded sleeve threadedly mounted on an element fixedly mounted in a carrier rotatably mounted on the base, the sleeve being threadedly actuatable to move the end of said sleeve around the end of the hook and away from the end of the hook.

PREFERRED EMBODIMENT

The preferred embodiment is shown in the attached drawings; structure and operation are now explained.

Drawings

STRUCTURE

Figure 1:
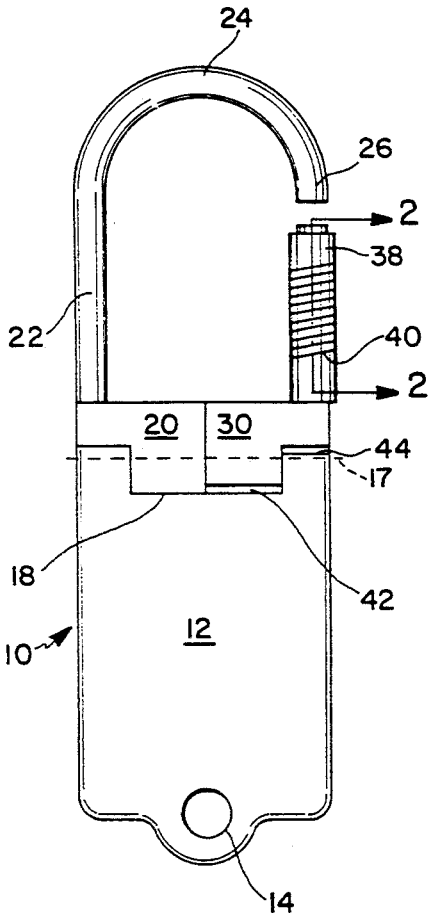
FIG. 1 is a side elevation view of said embodiment.

Turning now to FIG. 1, there is shown key holder 10 having a metal base 12 through which extends hole 14 adapted to accept a conventional key ring (not shown).

Fixedly mounted (by virtue of pin 16 and the flat bottom 18) on base 12 is support 20, in which is in turn fixedly mounted hook 22, which includes a semicircular portion 24 and a short straight portion 26.

Threaded rod 28 is also fixedly mounted in pivotal support 30 and includes base portion 32, threads 34, and tip 36.

Figure 2:
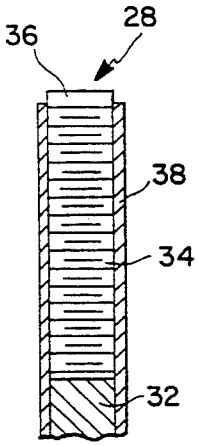
FIG. 2 is a partial sectional view taken at 2—2 of FIG. 1.

Threadedly mounted on rod 28 is sleeve 38 on the outside of which is helical knurl (not shown in FIG. 2) 40.

Pivotal support 30 has rounded lower portion 42 and is pivotally mounted along a on pin 16, which is mounted along a pin axis 17, which extends through both support 30 and support 20, and is force-fitted in the latter.

Base 12 has upper semicylindrical surface 44.

OPERATION

Figure 3:
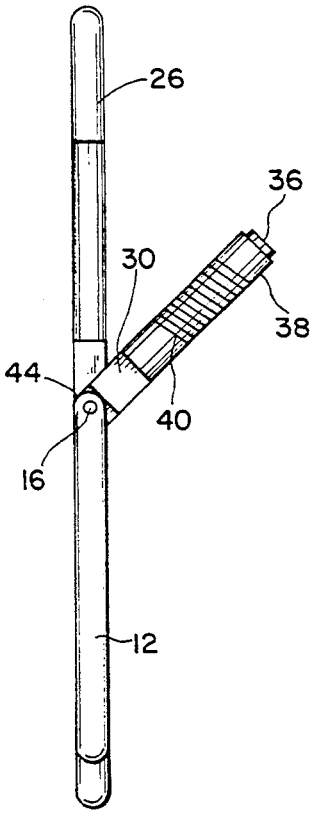
FIG. 3 is an end elevational view of said embodiment.

Starting with turned down on threads 34 to space end 36 from hook end 26, as shown in FIG. 1, the rod 28, sleeve 38, support 30 assembly may be rotated as shown in FIG. 3 (or in the opposite rotational direction, not shown), to produce, as shown in FIG. 3, a wide opening between end 26 and tip 36, to permit easy entry of, for example, thick base portions of modern automobile keys.

Rod 28 may then be rotated back, along with its associated parts as above mentioned, to coaxiality with end 26, and sleeve 38 turned on threads 34 until the end of sleeve 38 surrounds end 26, closing the gap therebeneath and securing the rod 28 and associated parts against rotation.

Semicylindrical portions 42 of support 30 and 44 of base 12 facilitate rotative movement of support 30.

OTHER EMBODIMENTS

Other embodiments within the invention will occur to those skilled in the art.

For example, the base may be omitted, with the hook and the sleeve-carrying elements having portions integral therewith and pivotally related through those portions. Or, the hook and a portion carrying the sleeve may be integral, with the sleeve being freely slidable on the portion carrying it, and biased toward the hook by a spring.

Indeed, a presently most-preferred embodiment, depicted in my design patent application filed herewith, has a transversely elongated hole instead of round hole 14, a much shortened base longitudinal dimension, both supports (in place of supports 20 and 30) pivotally supported relative to the base and to each other, and a sleeve (corresponding to 38) spring-biased toward its hook end (corresponding to 26).

I claim:

1. A key ring which comprises:

a flat base having a thickness, a width, an upper surface, and front and back surfaces, a first support having the same thickness as said base and a lower surface, a hook having a cross-section substantially smaller than said width, a rod having a cross-section substantially smaller than said width, a second support having the same thickness as said base and said first support, and a sleeve said base supporting said first support and said second support, said first support being fixedly mounted on said base longitudinally of said base, said first and second supports being mounted on said base by a pin mounted on said base along an axis, said first support being prevented from rotation owing to interference of said lower surface with said upper surface, said axis being parallel to planes of said front and back surfaces, said second support being rotatably mounted on said base longitudinally of said base and beside said first support for rotation about said axis of said pin, said hook being mounted in said first support and including a longer straight portion extending from said first support, a second portion, and an intermediate arcuate portion, said rod being carried by said second support for movement therewith and extending in one selectable position parallel to said longer straight portion, said rod being threaded at its end away from said second support, said sleeve being screw-threadedly carried by said rod.

* * * * *